US006575121B1

(12) United States Patent
Galjaardt

(10) Patent No.: US 6,575,121 B1
(45) Date of Patent: Jun. 10, 2003

(54) HOUSING FOR A HOT WATER SYSTEM

(76) Inventor: Richard A. Galjaardt, 2 Manley Circuit, Calwell ACT 2905 (AU)

( * ) Notice: Subject to any disclaimer, the term of this patent is extended or adjusted under 35 U.S.C. 154(b) by 0 days.

(21) Appl. No.: 09/949,011

(22) Filed: Sep. 6, 2001

(51) Int. Cl.[7] ..... B65D 90/08

(52) U.S. Cl. ..... 122/19.2; 122/494; 220/567.3; 220/694.1

(58) Field of Search ..... 122/13.01, 13.3, 122/18.5, 19.1, 19.2, 494; 220/567.3, 495.01, 694.1

(56) References Cited

U.S. PATENT DOCUMENTS 1,484,056 A * 2/1924 Birtch ..... 220/694.1
2,355,855 A * 8/1944 Goerg ..... 220/567.3
4,477,399 A * 10/1984 Tilton ..... 264/45.2
4,907,570 A * 3/1990 Lemense ..... 220/567.3
6,029,615 A * 2/2000 Terwilliger et al. ..... 122/494
6,182,613 B1 * 2/2001 McCraney ..... 122/19.2

* cited by examiner

*Primary Examiner*—Gregory Wilson
(74) *Attorney, Agent, or Firm*—Sierra Patent Group, Ltd.

(57) ABSTRACT

A prefabricated housing for an external hot water system located adjacent a house wall or the like is disclosed which has walling members including two side walls and a front wall, a roof, insulating means for insulating the walling members and the roof, and fastening means for releasably fastening the assembled housing to the house wall or the like.

7 Claims, 3 Drawing Sheets

HOUSING FOR A HOT WATER SYSTEM

TECHNICAL FIELD

The disclosure relates to a water heater enhancer and more particularly has an application to a water heater enhancer in the form of an insulated enclosure for an external domestic hot water system.

BACKGROUND

It is known for the heaters of hot water systems to be positioned outside a structured such as a house adjacent an exterior wall. Such location results in hot water system inefficiencies through heat losses, particularly in inclement weather.

SUMMARY

Disclosed is an alternative to known enclosures for hot water systems. The disclosure in one aspect resides broadly in a prefabricated housing for an external hot water system located adjacent an external structure such as a house wall or the like, the housing including, a walling means, a roof, an insulating means for insulating the walling means and the roof, and a fastening means for releasably fastening the assembled housing relative to the structure.

DESCRIPTION OF DRAWINGS

In order that this invention may be more easily understood and put into practical effect, reference will now be made to the accompanying drawings, wherein:

FIG. 8 is a detailed drawing of DETAIL 3 illustrated in FIG. 4 providing a detailed sectional elevation of the fastening means preferred for fastening the housing to a wall or the like;

DESCRIPTION OF PREFERRED EMBODIMENT

Figure 1:
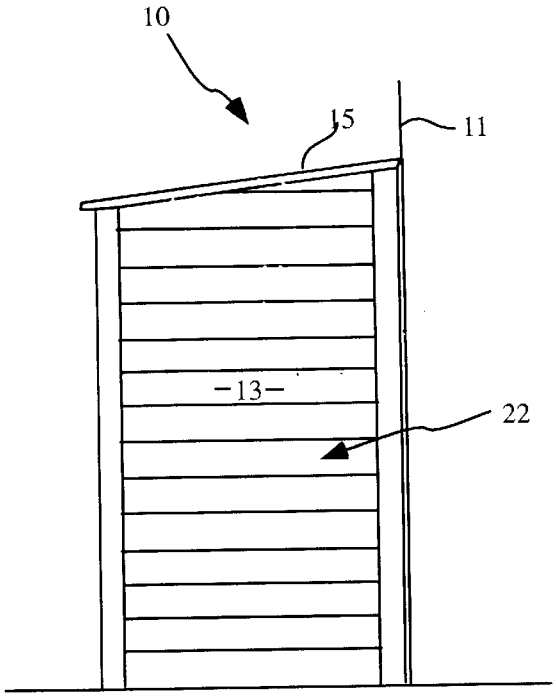
FIGS. 1, 2 and 3 respectively show an end elevation, front elevation and a roof plan of an exemplary hot water tank housing.
Figure 2:
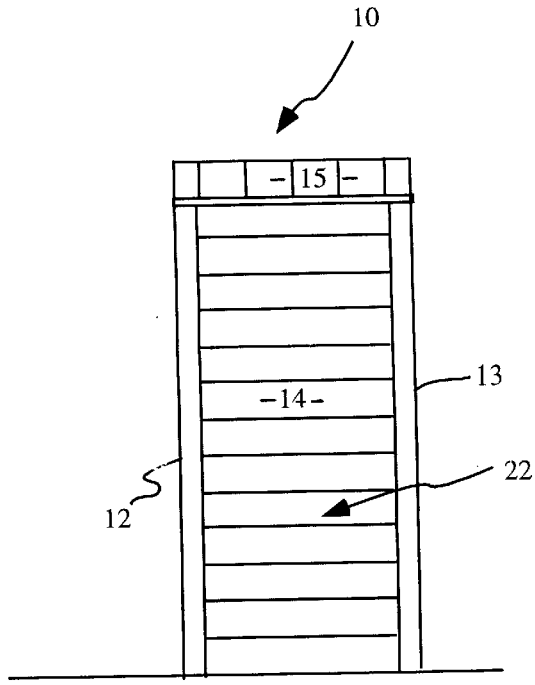
Figure 3:
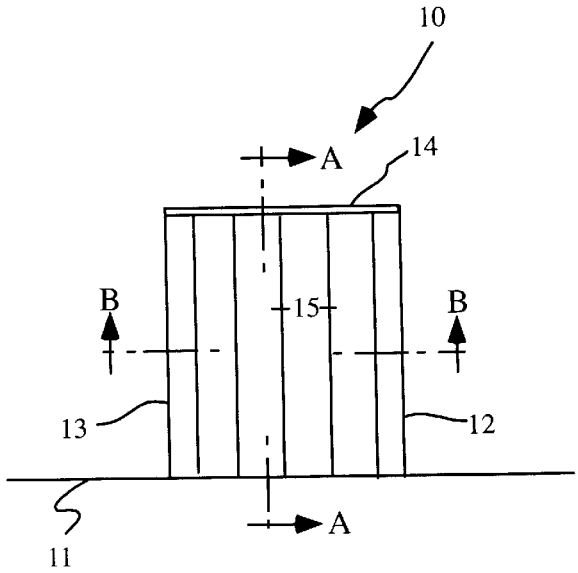
Figure 4:
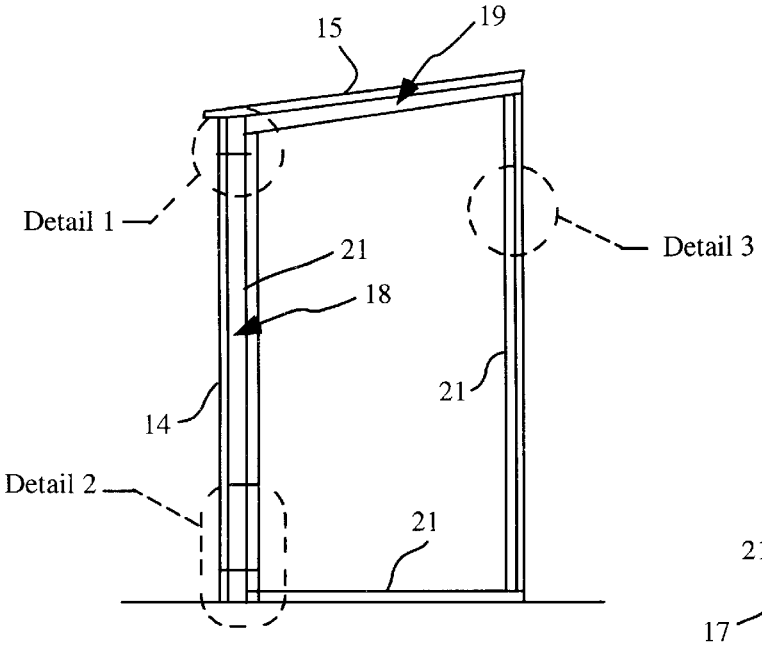
FIGS. 4 and 5 are sectional elevations of the housing along AA and BB as indicated on the roof plan view of FIG. 3.

As can be seen in FIGS. 1–5, a prefabricated housing 10 for an external hot water system (not shown) located adjacent a structure 11 such as a house wall or the like has walling means in the form of two side walls 12,13 and a front wall 14, a roof 15, insulating means such as insulated batting or bats 16, 17 and 18 in the form of polystyrene foam or like material having insulating properties for insulating the walling means 12, 13 and 14 and insulated batting or bat 19 for insulating the roof 15, and fastening means 44 (seen in more detail in FIG. 8 and explained subsequently by reference thereto) for releasably fastening the (assembled) prefabricated housing 10 relative to the structure 11 (house wall or the like).

As best seen in FIGS. 4–7, the walling means (i.e., the side walls and front wall) have side, top and bottom channel shaped frame members 21 which form respective frames about the insulating means (bats 16–19). The bats are thus each enclosed within a frame formed by the four frame members 21, the bats thereby bracing the frame. External cladding 22 is supported on the frame. A similar frame arrangement is used for roof 15.

Figure 8:
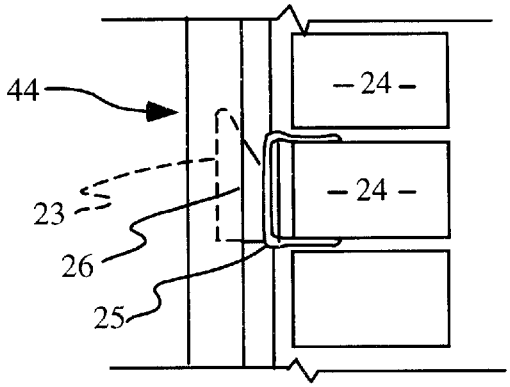

As seen in FIG. 8 the fastening means 44 for fastening the prefabricated housing 10 relative to structure 11 includes wedge shaped fins 23 for mounting to the structure 11 or in another embodiment a house wall in the grouting between bricks 24 by a U-shaped bracket 25. Fins 23 are received in slot-like recesses 26 along the rear sides of the side walls 12 and 13.

Figure 9A:
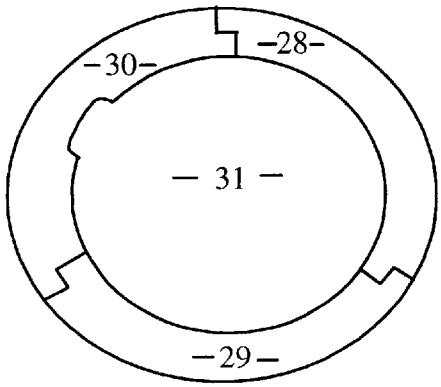
FIGS. 9A and 9B are side and plan views respectively of an insulating surround for positioning about a cylindrical hot water heater.
Figure 9B:
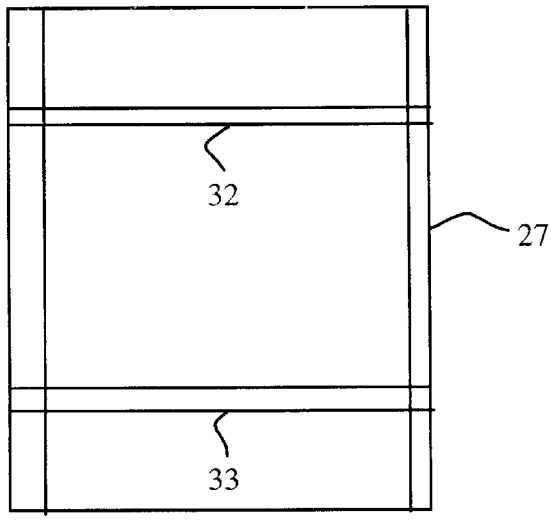

FIGS. 9A and 9B illustrate an insulating surround 27 made of three interlocking part cylindrical shields 28–30 adapted to substantially abut an external hot water system 31 (simply called a hot water system) and held in place by bands 32 and 33.

Figure 5:
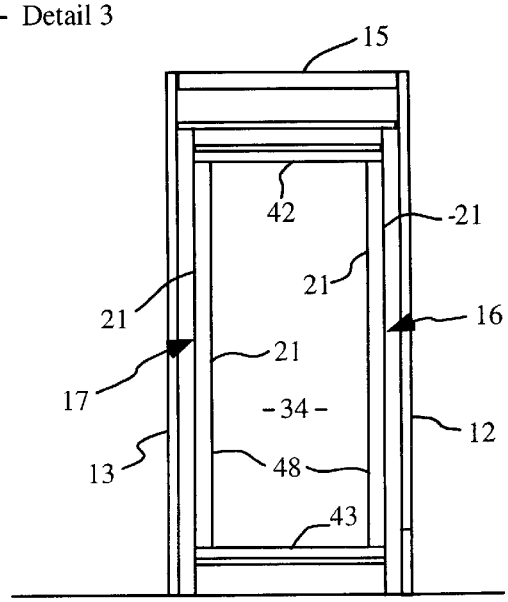
Figure 6:
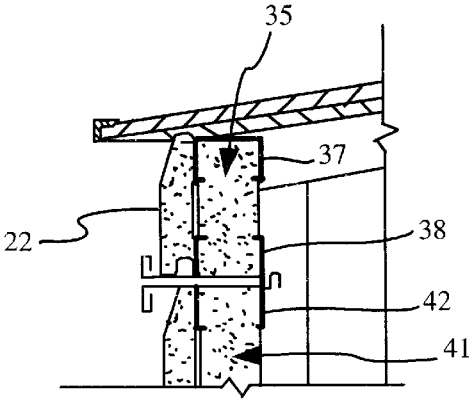
FIG. 6 is a detailed drawing of DETAIL 1 illustrated in FIG. 4 providing a detailed sectional elevation of the top joining rail of the wall panel of the housing for an electrically heated hot water tank.
Figure 7:
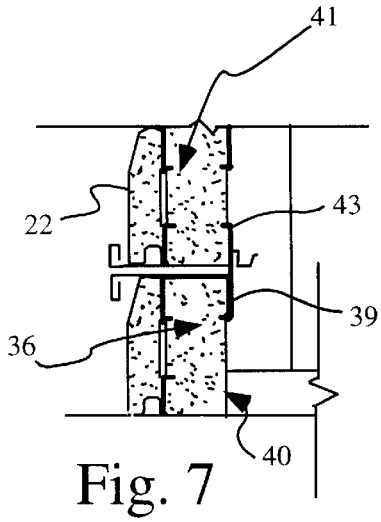
FIG. 7 is a detailed drawing of DETAIL 2 illustrated in FIG. 4 providing a detailed sectional elevation of the lower joining rail of the wall panel of the housing.

As illustrated in FIGS. 4–7, front wall 14 has a door 34 framed in a similar way to side walls 12 and 13 and to roof 15 by a door frame 48. Slabs of foam 35 and 36 are respectively sandwiched between channel frame members 37, 38 and 39, 40 to form top and bottom front wall panels respectively. Door 34 is formed by a sheet of foam 41 being mounted in a frame of which top rail 42, bottom rail 43 and side frame members 48 are seen in FIGS. 5, 6 and 7.

Figure 10:
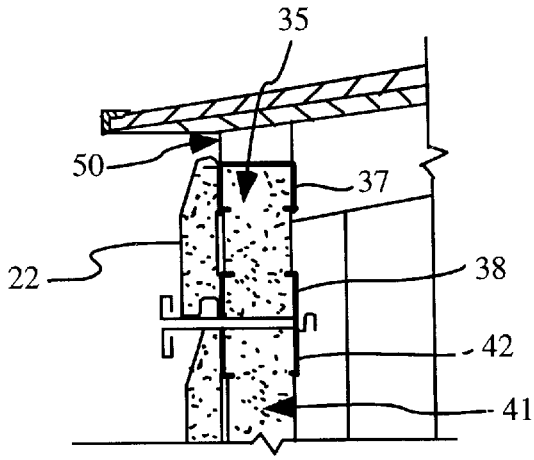
FIG. 10 is a detailed drawing of DETAIL 1 illustrated in FIG. 4 providing a detailed sectional elevation of the top joining rail of the wall panel of the housing for an gas heated hot water tank showing a vent extending along the top rail.

As seen in FIG. 10, the front wall top panel can be lowered so as not to reach completely to the roof. This may be achieved (as seen in FIG. 10) with the front wall top panel remaining the same as that seen in FIG. 6 and the height of the door being reduced slightly. Alternatively, the depth of the front wall top panel can be decreased slightly. Either arrangement thus provides a vent 50 extending along the top of the front wall front panel between the top thereof and the roof, in the event that such venting is required by building codes and local ordinances for gas heated hot water systems.

As can be seen in the drawings, the disclosure resides broadly in a prefabricated housing assembly for covering and insulating the external hot water system. The prefabricated housing (assembly) may optionally include the insulating surround 27 subsequently abutting the hot water system.

A preferred embodiment provides total coverage to an external water heater of the hot water system, with the assembly consisting of two sides, one roof, one door, and a top and bottom-joining rail. All panels are fully insulated with suitable material such as polystyrene, polyurethane, batts or any other energy rated materials.

Panels can be framed using any suitable materials such as metal, wood, or moulded plastic. The external side of the panels (except the roof) is covered using weather resistant and energy rated material such as plastic, wood, or metal.

The roof is covered with any suitable roofing materials such as metal, plastic, and wood. The door provides access to the water heater and is attached to one of the sides with the use of hinges with removable pins. The door can be attached using other suitable methods such as, for example, downwardly extending pins receivable in slots in the front wall lower frame member and resilient clips or catches in the jambs. The door is kept shut with the use of magnetic catches or any other product suitable for example, door lock.

The prefabricated housing is attached to the structure (wall) using one or more wedge shaped fins or hidden fin brackets or the like, which clamp and/or fixes this prefabricated housing to the brick or other wall material of the structure. These fins hook into a vertical slot on the back of the side panels and operate by simply lifting the side panels up off the ground and holding them against the structure. Pushing down the panel (of each wall) then locks or wedges the prefabricated housing unit in place.

The top and bottom joining rails have right-angled brackets at either side, which fit to the two side walls. The roof has right-angled brackets (not shown), which also fix to the side panels of the side walls, so keeping the prefabricated housing unit substantially square.

The housing is preferably constructed of materials suited to making it airtight and insulated so as to capture heat. The materials preferably used include timber, galvanized metal, rubber seals, insulation, a barrel bolt and hinges, rubber drainage hose, silicon, vinyl cladding, hinges or locating pins and barrels for the door, mounting brackets and fittings (screws, dyno bolts).

The design is such that it enables easy access to the water heater for repairs and the entire unit can be totally dismantled by the removal of eight screws.

The prefabricated housing can be constructed of different material such as plastic or fiberglass moldings, a variety of timbers or other materials suitable for constructing an airtight fixture, which protects the water heater from the elements.

The present application offers a number of advantages including minimizing the problems regarding external water heaters when exposed to weather extremes when such systems become inefficient and maintenance prone. It does this by capturing and recycling the heat otherwise lost from an unprotected outdoor hot water system. The arrangement of the disclosure has been found to significantly reduce the use and cost of both electricity and gas for hot water system heating.

It will of course be realized that whilst the above has been given by way of an illustrative example of this invention, all such and other modifications and variations hereto, as would be apparent to persons skilled in the art, are deemed to fall within the broad scope and ambit of this invention as is herein set forth.

What is claimed is:

1. A prefabricated housing for an external hot water system located adjacent a structure, the housing including:

a walling means;

a roof;

an insulating means for insulating the walling means and the roof, and a fastening means for releasably fastening the assembled housing relative to the structure, wherein the fastening means includes fins for mounting to the structure and slot-like recesses along the walling means for receiving the fins, and the walling means includes two side walls and a front wall.

2. A prefabricated housing as claimed in claim 1, wherein the walling and roof means include frame members forming a frame about the insulating means which is supported by and braces the frame, and external cladding supported on the frame.

3. A prefabricated housing as claimed in claim 1, wherein the fins are wedge shaped and the two side walls have rear sides opposite the front wall, wherein the two side walls include the slot-like recesses along the rear sides for receiving the fins.

4. A prefabricated housing as claimed in claim 1, and including an insulating surround adapted to substantially abut the external hot water system.

5. A prefabricated housing as claimed in claim 1, wherein the prefabricated housing includes connecting means for connecting the walling means and the roof.

6. A prefabricated housing as claimed in claim 5, wherein the walling means includes a door.

7. A prefabricated housing as claimed in claim 6, wherein a venting gap is provided between the top of at least one of the walling means and the roof.

* * * * *